US006432202B1

(12) United States Patent
Aurich

(10) Patent No.: US 6,432,202 B1
(45) Date of Patent: Aug. 13, 2002

(54) TEXTILE YARN SLASHING SYSTEM

(75) Inventor: Christoph W. Aurich, Stanley, NC (US)

(73) Assignee: Gaston Systems, Inc., Stanley, NC (US)

( * ) Notice: Subject to any disclaimer, the term of this patent is extended or adjusted under 35 U.S.C. 154(b) by 0 days.

(21) Appl. No.: 09/175,651

(22) Filed: Oct. 20, 1998

(51) Int. Cl.[7] ..... B05C 3/02

(52) U.S. Cl. ..... 118/420; 118/411; 28/178; 28/179

(58) Field of Search ..... 28/178, 179, 182, 28/200; 222/318, 424; 118/72, 73, 412, 405, 409, 411, 419, 420; 239/597, 124, 127; 251/261; 137/115.01; 427/434.4, 434.6, 434.3, 434.7, 434.5

(56) References Cited

U.S. PATENT DOCUMENTS

| | | | | | |
|---|---|---|---|---|---|
| 40,484 | A | * | 11/1863 | Hyde | |
| 2,598,207 | A | * | 5/1952 | Bailey et al. | 251/261.1 |
| 2,693,096 | A | * | 11/1954 | Quinn | 118/420 |
| 2,980,956 | A | * | 4/1961 | Whitehurst | 118/DIG. 18 |
| 3,485,210 | A | * | 12/1969 | Warren | 118/420 |
| 3,741,153 | A | * | 6/1973 | Sear et al. | 118/420 X |
| 3,841,566 | A | * | 10/1974 | Wilford | 239/568 |
| 4,023,526 | A | | 5/1977 | Ashmus et al. | |
| 4,061,001 | A | | 12/1977 | von der Eltz et al. | |
| 4,061,271 | A | * | 12/1977 | Kimbrough | 239/1 |
| 4,095,558 | A | * | 6/1978 | Ellegast et al. | 118/420 |
| 4,159,355 | A | | 6/1979 | Milnes et al. | |
| 4,237,818 | A | | 12/1980 | Clifford et al. | |
| 4,297,860 | A | | 11/1981 | Pacifici et al. | |
| 4,305,169 | A | | 12/1981 | Vidalis | |
| 4,340,621 | A | * | 7/1982 | Matsumiya et al. | |
| 4,343,835 | A | | 8/1982 | Jones et al. | |
| 4,364,157 | A | * | 12/1982 | Cutts | 28/179 |
| 4,398,665 | A | | 8/1983 | Bryant et al. | |
| 4,402,200 | A | | 9/1983 | Clifford et al. | |
| 4,500,039 | A | | 2/1985 | Pacifici et al. | |
| 4,502,304 | A | | 3/1985 | Hopkins | |
| 4,530,876 | A | * | 7/1985 | Broadmann et al. | 428/283 |
| 4,565,153 | A | * | 1/1986 | Corley | 118/405 |
| 4,579,078 | A | * | 4/1986 | French | |
| 4,581,254 | A | | 4/1986 | Cunningham et al. | |
| 4,655,056 | A | | 4/1987 | Zeiffer | |
| 4,773,110 | A | | 9/1988 | Hopkins | |
| 4,793,035 | A | * | 12/1988 | Nehrenberg et al. | 28/183 |
| 4,943,451 | A | | 7/1990 | Zimmer | |
| 4,982,687 | A | * | 1/1991 | Takahashi et al. | 118/410 |
| 5,008,131 | A | | 4/1991 | Bakhshi | |
| 5,009,932 | A | | 4/1991 | Klett et al. | |
| 5,084,305 | A | * | 1/1992 | Marttila | |
| 5,145,527 | A | | 9/1992 | Clifford et al. | |
| 5,165,261 | A | | 11/1992 | Cho | |
| 5,219,620 | A | | 6/1993 | Potter et al. | |
| 5,913,976 | A | * | 6/1999 | Patton et al. | 118/429 |

FOREIGN PATENT DOCUMENTS

| | | |
|---|---|---|
| GB | 2 021 658 | 12/1979 |
| GB | 2 134 820 | 8/1984 |

* cited by examiner

*Primary Examiner*—Brenda A. Lamb
(74) *Attorney, Agent, or Firm*—Kennedy Covington Lobdell & Hickman, LLP

(57) ABSTRACT

A textile yarn slashing system having a foam applicator disposed therein for pre-wetting the sheet of yarns prior to passing through the size box. The foam is delivered under pressure and a resilient hold down member opposes the slot to create a space for foam on the opposite side of the yarn sheet from the slot for application of foam to both sides of the yarn sheet. A flexible cover sheet covers the surface of the hold down member and is shifted to replace a worn portion with an unworn portion opposite the slot. A valve assembly is incorporated in the applicator to close off the passage to the slot and permit bypass flow of the foam. End seal blocks have rigid metallic outer chamber engaging surfaces and resilient material interior of the surfaces to press the surfaces against the sides of the chamber adjacent the slot. A plurality of horizontal tubes may be used as an alternate to the slot with one or more yarns traveling through each tube.

32 Claims, 9 Drawing Sheets

TEXTILE YARN SLASHING SYSTEM

FIELD OF THE INVENTION

The present invention relates to a textile yarn slashing system of the type wherein a sheet of parallel running yarns are passed through a size bath for application thereto of sizing that facilitates handling of the yarn in subsequent textile processing procedures.

BACKGROUND OF THE INVENTION

Slashing systems are conventionally used for applying size to textile yarns to lubricate the surface of the yarns and to reduce surface hairiness, thereby facilitating handling of the yarn and reducing wear of machine parts in subsequent processing of the yarn into fabric. In such slashing systems, sheets of separate individual yarns are trained from rolls of yarn mounted on creels over rollers to a size bath and down into the size bath under a submerged roller and then up through nip rollers and over to other rollers for feeding through a drying chamber from which the yarns are wound, such as, for example, on warp beams. Conventionally, the yarns are dry when they are fed to the size bath and the dry yarns take up size into the interior so that sufficient size must be applied to allow for the take-up while providing full surface application. While sizing material itself is relatively inexpensive, the amount of size that is applied results in a significant cost factor.

Attempts have been made in the past to reduce the cost of size applied by reducing or controlling the amount of size applied. One heretofore commercially unsuccessful attempt has been to pre-wet the yarn to reduce the take up of size into the interior of the yarn while distributing the size over the entire surface of the yarn. An example of this involves passing the yarn through a bath of water and then through nip rolls to reduce the water content. However, nip rolls cannot reduce the water content sufficiently, leaving the yarn too wet for uniform and sufficient application of size.

Another pre-wetting system that has been attempted is to spray water on the yarn before it passes into the slasher. This also has not been successful because the atomized water particles do not spread evenly over the surface of the yarn, resulting in an uneven pick-up of size.

Yet another system that has been tried is the use of kiss rolls, that pick up water in a bath in which the roll is partially submerged and applies the picked up water from the roll onto the surface of the yarn. However, due to the high production speed necessary for practical commercial operation of slashers, there is not sufficient time for the water to wick from the surface to which it has been applied over the entire yarn surface in the short distance traveled by the yarn from the kiss roll to the size bath.

SUMMARY OF THE INVENTION

By the present invention, yarns advancing through a textile slashing system are pre-wet sufficiently to reduce the amount of size pickup by the yarns need to properly condition the yarns for subsequent processing, thereby resulting in a significant saving in the cost of size. This is accomplished by passing the yarn through a foam applicator prior to entry into the size box.

The foam applicator of the present invention has a slot extending lengthwise transversely across and facing one surface of the sheet of yarns for delivery of foam thereto. The open extent of the slot in the direction of yarn advance is relatively wide to extend the exposure of the sheet of yarns to the foam in the slot. Preferably, the applicator applies the foam under pressure so that the foam is forced through the sheet of yarns and onto the surface opposite the surface facing the slot.

In the preferred form of the applicator, the slot extends across and faces one surface of the sheet of yarns and a holddown member opposes and covers the slot for passage of the sheet of yarns therebetween and to define with the slot a foam pressure chamber. Preferably, the holddown member is formed of resilient material that is compressed by the pressurized foam to provide a space for the foam on the opposite side of the sheet of yarns from the slot. Also preferably, the slot is relatively wide to facilitate the extent of compression of the resilient holddown member to assure a space for proper foam application to all the surfaces of the yarn.

In an alternative arrangement, two foam applicators can be provided in sequence, one facing one surface of the sheet of yarns and the other facing the other surface.

An alternate feature of the present invention is the provision in an applicator for applying foam material to a traveling substrate of a sheet of flexible material covering a resilient holddown member that faces an applicator slot, with the covering sheet being advanceable from a supply to replace worn covering material with unworn covering material during operation of the applicator. The holddown member is compressible and, when used with a pressure applicator is compressed by the pressurized foam to provide a space opposite the slot and through which the substrate travels.

Yet another feature of the present invention is an applicator for applying foam material to a traveling sheet of individual aligned strands, such as the sheet of yarns in a textile yarn slashing system, of a plurality of parallel tubes containing foam and through which the strands of sheets of strands advance. Preferably there are openings adjacent the upstream ends of the tubes through which foam is introduced into the tubes and, when the applicator is a pressure applicator, foam seals are provided at the upstream and downstream ends of the tubes.

The present invention also includes an applicator flushing feature in which an applicator for applying foam material to a traveling substrate, such as sheets of yarn in a textile yarn slashing system, has a main foam passage through which foam is supplied to the substrate and a by-pass passage through which foam may be discharged for flushing of the applicator. A normally open valve is disposed in the main passage downstream from the by-pass passage and is closeable during flushing. A normally closed valve in the by-pass passage is closed during foam application through the main passage and is openable during flushing. In the preferred embodiment, these valves are inflatable bladders that are inflated to extend across the respective passages to close the passages.

Further, the present invention includes an end seal feature whereby end seals are provided in an applicator for applying foam material to a traveling substrate, where the applicator has a slotted member with a slot facing one surface of the traveling substrate and extending thereacross and has a passage having straight sides adjacent the slot for delivery of foam therethrough to the slot. An adjustable end seal member is disposed in the straight sided passage and has flat side surfaces of rigid material disposed in sealing relation to the straight sides of the passage and have resilient interior material urging the side surfaces into sealing engagement with the passage straight sides. In the preferred embodiment, the seal member includes a rigid core having sides extending generally parallel with the passage, a layer of resilient interior material secured to each side of the core and rigid material side surfaces secured to the resilient layers. Alternatively, the resilient interior material may be the core with a layer of rigid material secured to each side of the core and forming the flat side surfaces thereon.

In a further alternative embodiment the foam applied to the yarns by the applicator contains sizing material in a sufficient amount to properly condition the yarn for subsequent processing.

DETAILED DESCRIPTION OF THE PREFERRED EMBODIMENTS

Figure 1:
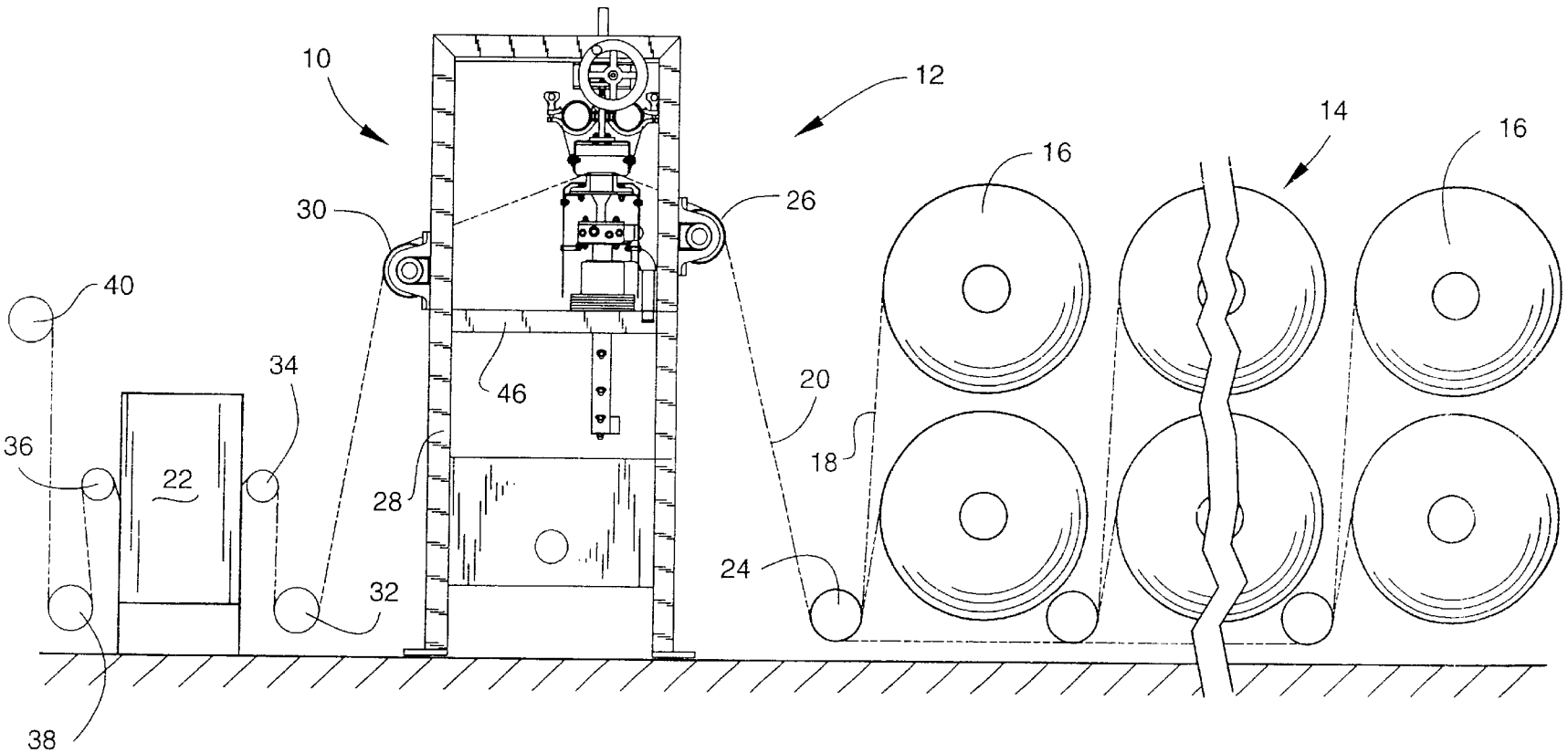
FIG. 1 is a schematic side elevation of a textile yarn slashing system according to the preferred embodiment of the present invention.

In the preferred embodiment illustrated in FIGS. 1–7, the foam applicator 10 of the present invention is incorporated in a textile yarn slashing system 12 that includes a yarn supply device in the form of a creel 14 of a plurality of rolls 16 of yarn 18, which combine into a sheet 20 of individual aligned yarns. The sheet 20 is fed through the foam applicator 10 that is disposed between the creel 14 and a size box 22. In this passage, the yarn sheet 20 passes under a guide roll 24 at the end of the creel 14, up to and over an entry roll 26 on the foam applicator frame 28, through the applicator 10, over an exit roll 30 on the applicator frame 28, under a guide roll 32 on the entry side of the size box 22, up to and over an entry roll 34 of the size box 22, down into the size box and up therefrom over an exit roll 36 of the size box 22, then under a guide roll 38 on the exit side of the size box 22, and up and over a feed roll 40 from which the yarn sheet 20 travels through nip rolls (not shown) and a dryer (not shown). The creel 14, size box 22, nip rolls and dryer are conventional and are not part of the present invention, except to provide the environment in which the foam applicator 10 of the preferred embodiment is incorporated.

The foam applicator 10 applies an aqueous foam that also includes a surfactant to pre-wet the yarn sheet 20 passing therethrough. As a result, when the yarn passes through the size box, much less size is picked up in comparison with the conventional running of dry yarn through a size box as the water of the broken down foam has already wetted the interior of the yarn such that the size will be picked up primarily on the surface of the yarn where it is needed for conditioning of the yarn for subsequent processing. As explained further below, the foam applicator applies the foam uniformly around each yarn in a pressure application with the amount of pick-up being controlled so that the yarn remains capable of picking up sufficient sizing material uniformly throughout the surface of the yarn to assure adequate, yet optimally minimal pick-up of size.

The foam is supplied to the applicator 10 from a conventional foam generator through conduits to a parabolic foam distribution chamber 42. In the illustrated embodiment, this foam distribution chamber 42 is of the type disclosed in Zeiffer U.S. Pat. No. 4,655,056, issued Apr. 7, 1987, assigned to the assignee of the present invention. Preferably, the foam is applied at a pressure in the range of 0.05 to 5.0 p.s.i. and the volume of foam applied is controlled depending on the application in relation to the characteristics of the yarn and the rate at which the yarn passes through the applicator. A typical pick-up is in the range of 5% to 60% of the dry weight of the yarn. A conventional controller for a foaming system is disclosed in Clifford and Zeiffer, U.S. Pat. No. 4,237,818, issued Dec. 9, 1980.

Figure 2:
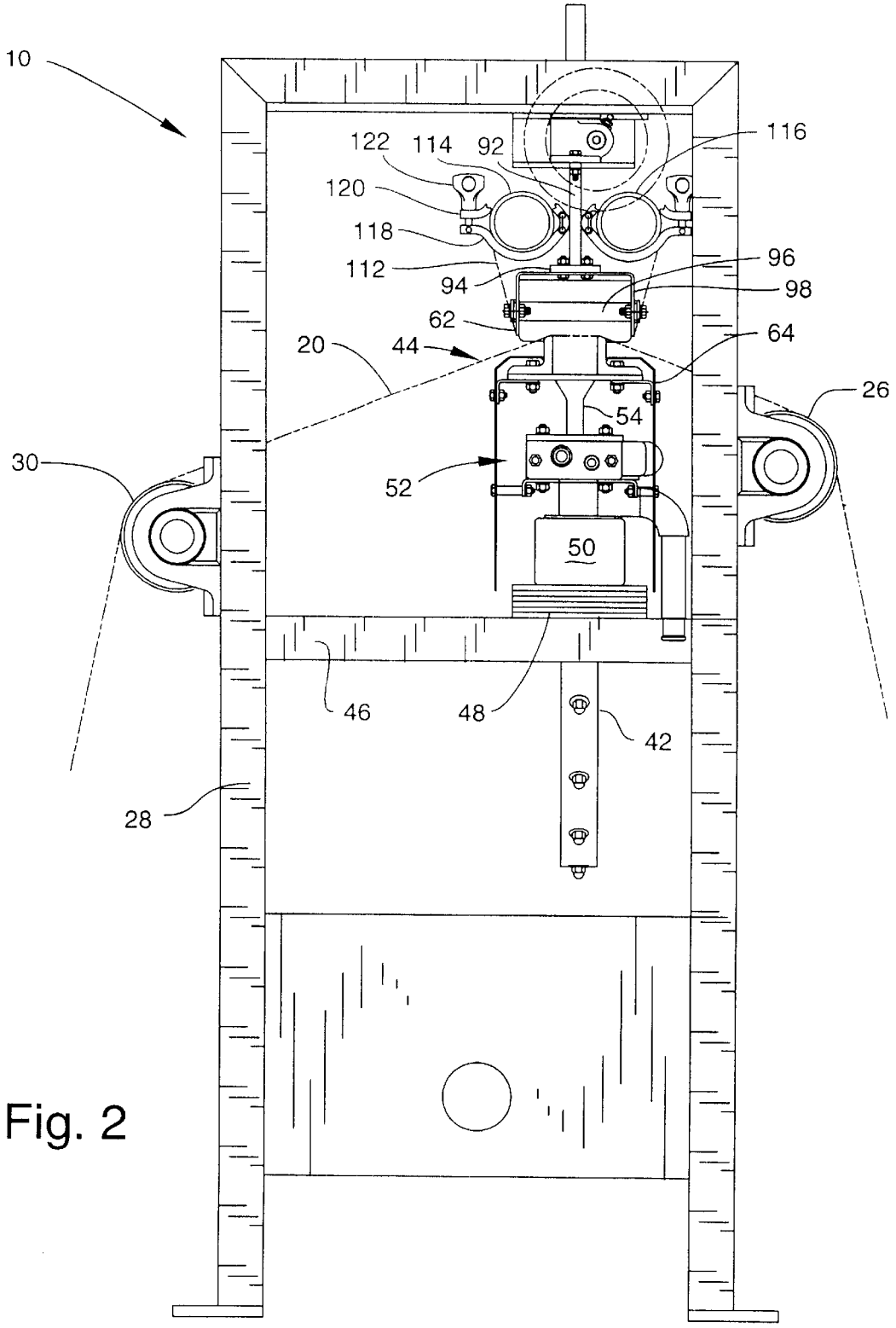
FIG. 2 is an enlarged side elevation of the foam applicator device of the slashing system of FIG. 1.
Figure 3:
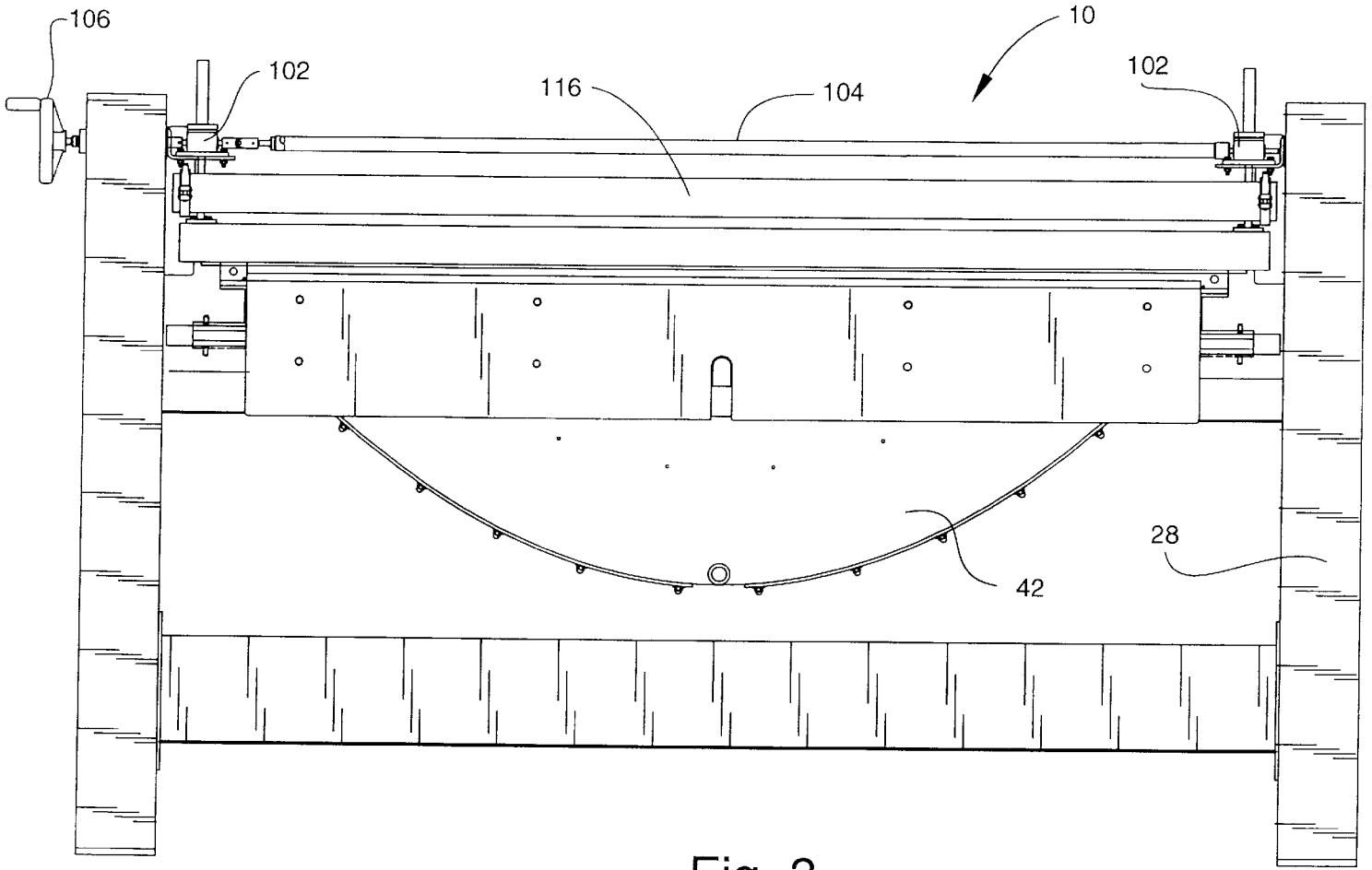
FIG. 3 is a transverse elevational view of the applicator of FIG. 2.

As seen in FIG. 2, the head 44 of the applicator is mounted on a cross beam 46 that is supported on shim plates 48 on cross bars 50 at each end of the frame 28. A foam passage extends upwardly through the cross beam 46, through a valve assembly 52 through a delivery passage between transverse plates 54 that flare at their upper ends, as at 56, for extending the width of the passage of foam into a widthwise enlarged chamber 58 that is open at its upper end to provide a foam applicating slot 60. The sheet of yarn 20 is guided to pass over the slot 60 for application of foam thereto.

The foam is maintained under pressure in the slot 60 by a holddown member 62 that is above the slot 60 and pressing down thereagainst, with the yarn sheet 20 advancing through the applicator head 44 between the slot 60 and holddown member 62.

Cover plates 64 are secured along each side of the applicator head 44 by bolts. These cover plates 64 are disposed below and to the sides of the slot 60 exteriorly of the applicator head 44 and extend downwardly along each side.

Figure 4:
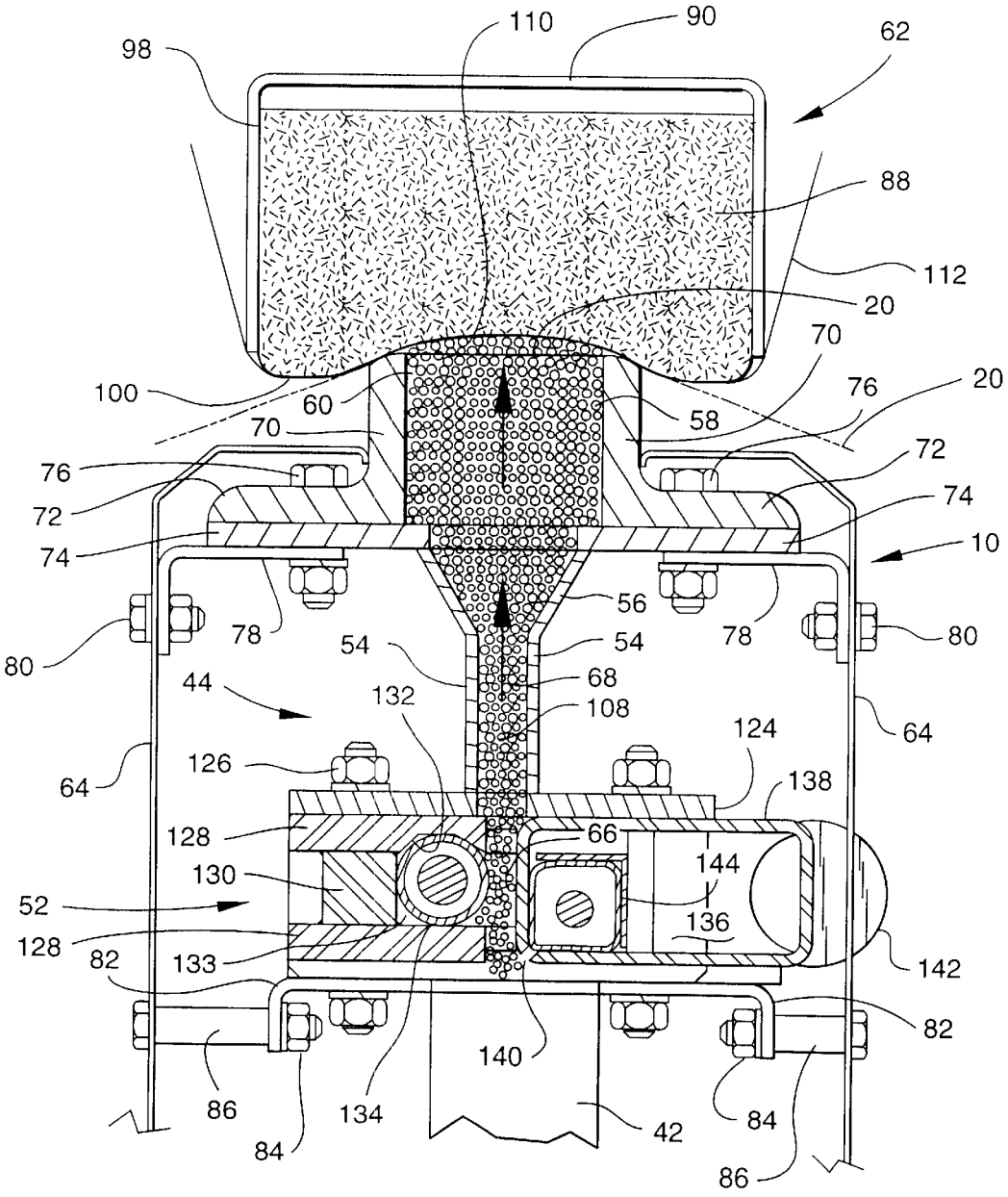
FIG. 4 is an enlarged cross-sectional view of the applicator head of the applicator of FIG. 2 as viewed through the applicator head in a plane parallel to the direction of travel of the yarn sheet.

In the enlarged sectional view of FIG. 4, there can be seen the foam passage 66 through the valve assembly 52, the foam delivery passage 68 between the transverse plates 54, with the passage widening upwardly in the flared portion 56 of the transverse plates, with the delivery passage 68 opening into the widened chamber 58 that provides for distribution to the full width of the slot 60 at its upper end. The chamber 58 is formed by two angle bars 70 that have horizontal legs 72 bolted to flat support plates 74 that extend across the frame 28. The horizontal legs 72 of the angle bars 70 are secured to the support plates 74 by bolts 76. These bolts 76 also secure brackets 78 on the underside of the support plates 74 that extend laterally with outer downwardly extending portions to which the cover plates 64 are secured by bolts 80. Similar brackets 82 are secured to the underside of the valve assembly 52 and extend outwardly and then downwardly for attachment to the cover plates 80 by bolts 84 that extend through spacers for cooperating with the upper brackets 78 to support the cover plates 64 in a vertical disposition.

The valve assembly 52, transverse plates 54, and angle bars 70 extend across the full extent of the yarn sheet 20 so that the passage 66 in the valve assembly 52, the delivery passage 68 between the transverse plates 54, the chamber 58 and the slot 60 extend fully across the width of the travelling yarn sheet 20 for application of foam material uniformly to the entire width of the yarn sheet 20. It is not necessary that the passage 66 in the valve assembly 52 be narrower than the wide chamber 58. Rather, the passage 66 in the valve assembly 52 could be provided as wide as the slot 60, thereby eliminating the need for the flaring transverse plates 54. With a wider valve assembly passage 66 some modification may be necessary in the valving arrangement described hereinbelow.

The holddown member 62 includes a block 88 of resilient foamed plastic material that extends in covering relation over the entire width and length of the slot 60 and beyond the angle bars 70 in both the entry and exit directions of the travelling yarn sheet 20. This block 88 is, in the preferred embodiment, formed of cellular polymer foam and is retained in a rigid downwardly opening channel 90 that is secured to the frame 28 at each side of the applicator 10 by rods 92 that are attached to the top of the channel through a flat strip 94 that extends to and between the rods 92 for rigid support of the channel 90. The resilient block 88 is retained at the ends of the channel 90 by end straps 96 that extend across the channel ends and are bolted to the vertical channel legs 98.

The rods 92 are connected to the frame 28 through a gear box 102 at each end of the frame 28, which gear boxes 102 are connected by a connecting rod 104 extending therebetween, with the gear boxes 102 and connecting rod 104 being manipulated by a hand wheel 106 to raise and lower the holddown member 62 to vary the pressure of the resilient block 88 against the slot 60. In FIGS. 2 and 4, the resilient block 88 is shown positioned with the outer portion of its underside 100 below the level of the slot. This provides a necessary sealing of the chamber 58 to prevent the pressurized foam from escaping and maintains the yarn sheet 20 in position across the slot 60.

As seen in FIG. 4, the pressurized foam 108 in the chamber 58 passes through the slot 60 and the pressure causes deformation of the resilient block 88 above the slot 60 to form a space 110 above the slot 60. As the yarn sheet 20 extends straight across the slot 60, the foam passes through the yarn sheet 20 and occupies the space 110 thereabove so that foam is applied to both the underside of the yarn sheet 20 from the chamber 58 and to the upper side of the yarn sheet 20 from the space 110. The slot 60 is formed sufficiently wide in the direction of travel of the yarn sheet 20 for optimum uniform application of foam, with the wide slot 60 providing for sufficient deformation of the resilient block 88 to form the space 110 of adequate size for optimum application of foam. In the preferred embodiment, the slot is 2" wide for application of foam to a sheet of 4,000 to 7,000 yarns traveling at a speed of between 40 to 100 yards per minute.

As the underside 100 of the resilient block 88 is subjected to wear by the travelling yarns against which the block is pressed, the preferred embodiment of the present invention provides for a protective sheet 112 of flexible metallic or plastic material that extends from a supply roll 114 mounted to one side and above the holddown member 62 and a take-up roll mounted above and to the other side of the holddown member 62. These supply and take-up rolls 114, 116 extend the full width of the yarn sheet 20 and are supported in a lower clamp bracket 118 at each end of the frame 28 secured to the rods 82. Releasable top clamp brackets 120 cooperate with the lower clamp brackets 118 by the use of wing nuts 122 to clamp the supply and take-up rolls 114, 116 in position. When the portion of the protective sheet 112 that is covering the underside 100 of the resilient block 88 becomes worn, the wing nuts 122 of the brackets 118, 120 are released and the supply and take-up rolls 114, 116 are manually rotated to move an unworn portion of the protective sheet 112 in place at the underside 100 of the resilient block 88.

Figure 5:
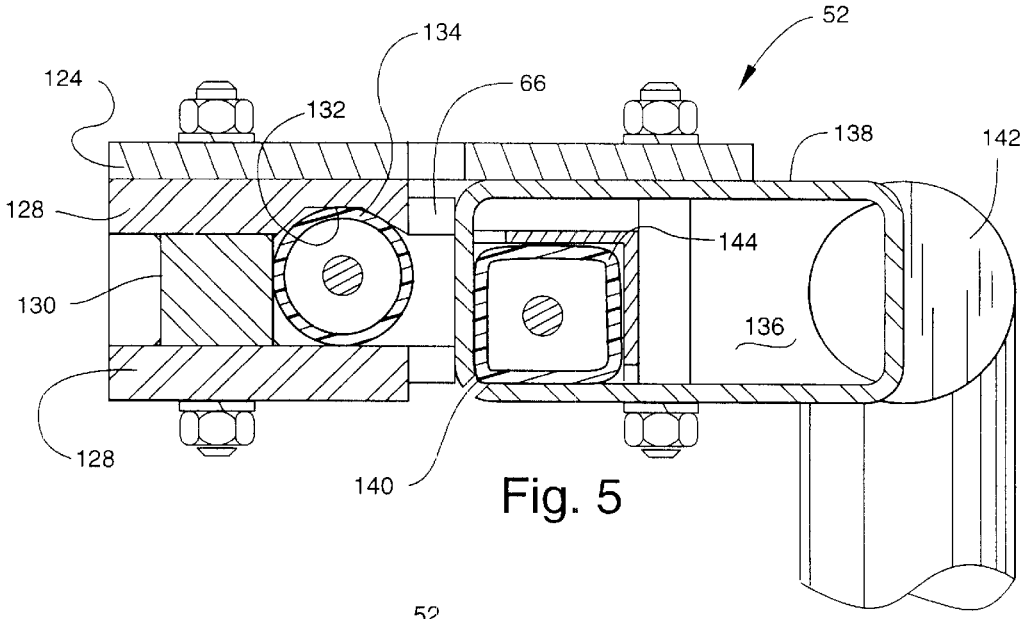
FIG. 5 is an enlarged cross-sectional view of the main and bypass valve members section of the applicator head of FIG. 4 showing the valve member in their position during application of foam through the applicator head to the sheet of yarns with the bypass valve member expanded to block passage of foam to the by-pass passage.
Figure 6:
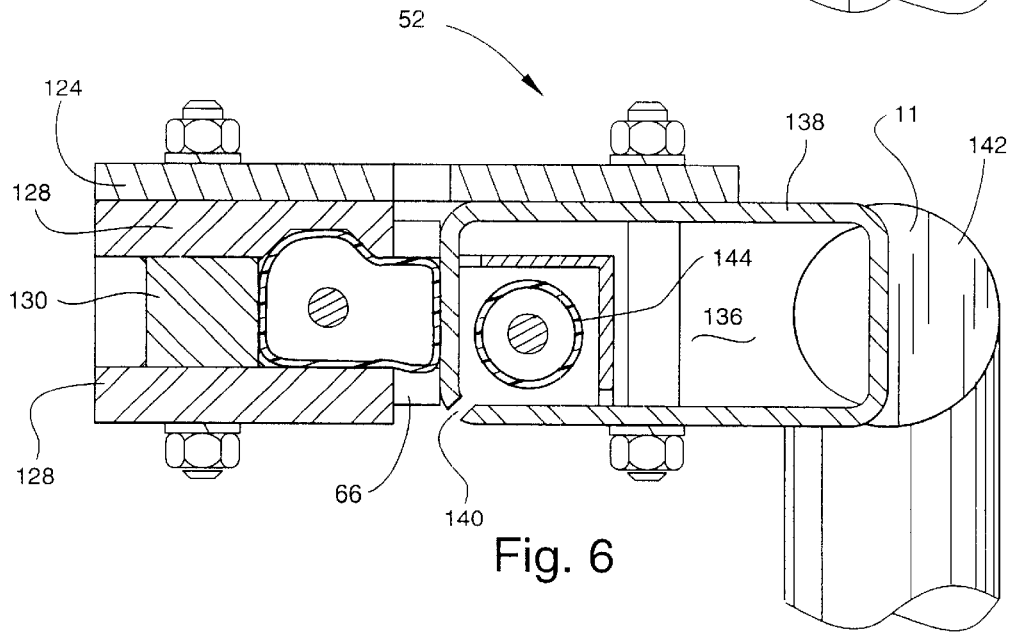
FIG. 6 is a view similar to FIG. 5 showing the main value member expanded to block passage of foam to the slot of the applicator and showing the bypass seal retracted to permit foam to bypass from the applicator head.

The valve assembly 52 is illustrated in detail in FIGS. 4, 5 and 6. A top plate 124 retains, by bolts 126, valve member retaining plates 128 that are spaced by a spacer bar 130. These valve member retaining plates 128 and spacer bars 130 are located to one side of the valve assembly passage 66 and form an opening 133 facing the passage. The underside of the upper retaining plate 128 is recessed upwardly, as at 132, to retain in the space 133 a valve member in the form of a tubular rubber-like bladder 134 that is normally in a deflated position out of the path of the valve assembly chamber 66 for flow of full material therethrough during normal operation. This valve assembly passage valve bladder 138 is pneumatically expandable in a conventional manner, as illustrated in FIG. 6, to block the passage of foam through the valve assembly passage 66 to interrupt discharge of foam through the applicator slot 60 during start up or for flushing of the system when it is desirable. At start up of the applicator, it may be desirable to run the foam through the system until the foam reaches the proper condition for application and, during temporary interruption of foam application, it may be important that foam continue to flow through the system so that the foam will not break down in the system and will be in condition for proper resumption of application upon termination of the interruption. Also, when an operation is completed and the system is to be shut down, it is important that the system be flushed of foam. For these purposes, the valve assembly 52 includes a bypass chamber 136 formed in a hollow rectangular member 138 secured under the valve member retaining plate 120 on the side of the valve assembly passage 66 opposite the valve assembly passage valve member 134. A bypass slot 140 is formed to extend along the full extent of the lower inner corner of the rectangular member 138 for flow of foam therethrough into the rectangular member 138 and outwardly through a discharge pipe 142. Retained adjacent the bypass slot 140 in the rectangular member 138 is a bypass valve member in the form of an expandable resilient rubber-like bladder 144 that extends along the full extent of the bypass slot 140 and is inflatable pneumatically by any conventional device. During normal operation of the applicator 10, the bypass bladder 144 is inflated to seal off the bypass slot 140, as seen in FIGS. 4 and 5. When the valve bladder 134 is inflated to block off the valve assembly passage 66 and interrupt the flow of foam to the applicator slot 60, the bypass bladder 144 is deflated to open the bypass slot 140 for flow of foam through the slot 140 and through the rectangular member 138 for discharge through the pipe 142. There also may be conditions where it is desirable to have both the main passage and the by-pass passage open, for which purpose both valve members may be deflated.

Figure 7:
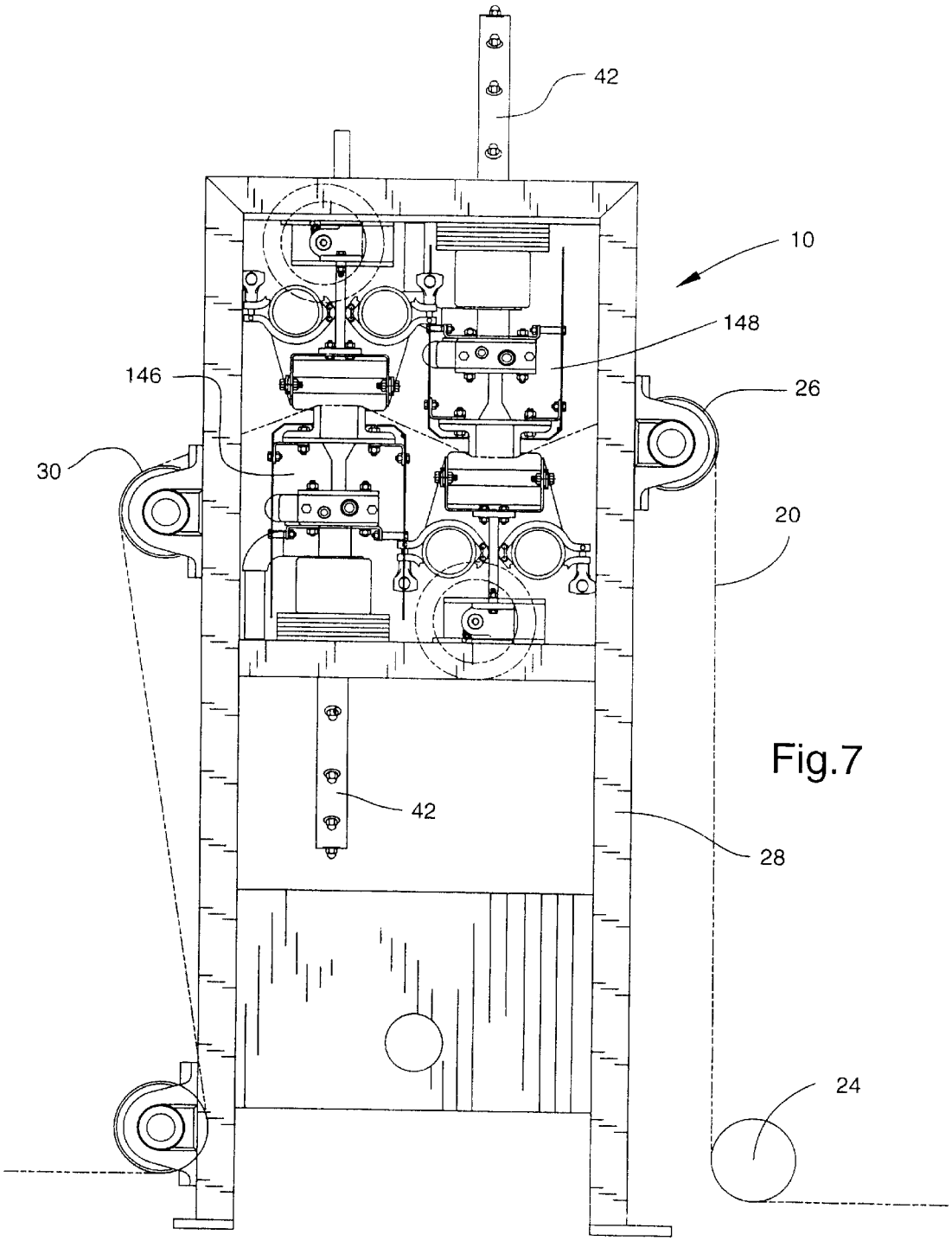
FIG. 7 is a view similar to FIG. 2 showing an alternate embodiment of the present invention in which there are two foam applicators applying foam to opposite sides of the sheet of yarns.

In some applications the foam applied using one applicator may not be sufficient and it may by desirable to apply foam separately to both sides of the yarn sheet 20 directly. In such a case, a second applicator may be mounted in the frame as illustrated in FIG. 7. In this alternative embodiment, a first applicator 146 is mounted in one side of the frame 28 and is identical to the applicator described above with respect to FIGS. 1–6. A second applicator 148 is mounted in the frame 28 alongside the first applicator 146 and is inverted with its slot facing downwardly and the holddown member facing upwardly. This second applicator 148 is identical to the applicator described above with respect to FIGS. 1–6 except for being inverted. In this arrangement, the yarn sheet 20 first passes under the applicator head 44 and over the holddown member 62 of the second applicator 148 to apply foam from the slot 60 directly to the upper side of the yarn sheet 20 and then passes over the applicator head 44 and under the hold down member 62 of the first applicator 146 to apply foam directly from the slot 60 to the underside of the travelling yarn sheet 20. Should it be desirable for full foam application during particular circumstances, more than two applicators may be incorporated in a frame or in a plurality of frames.

Figure 8:
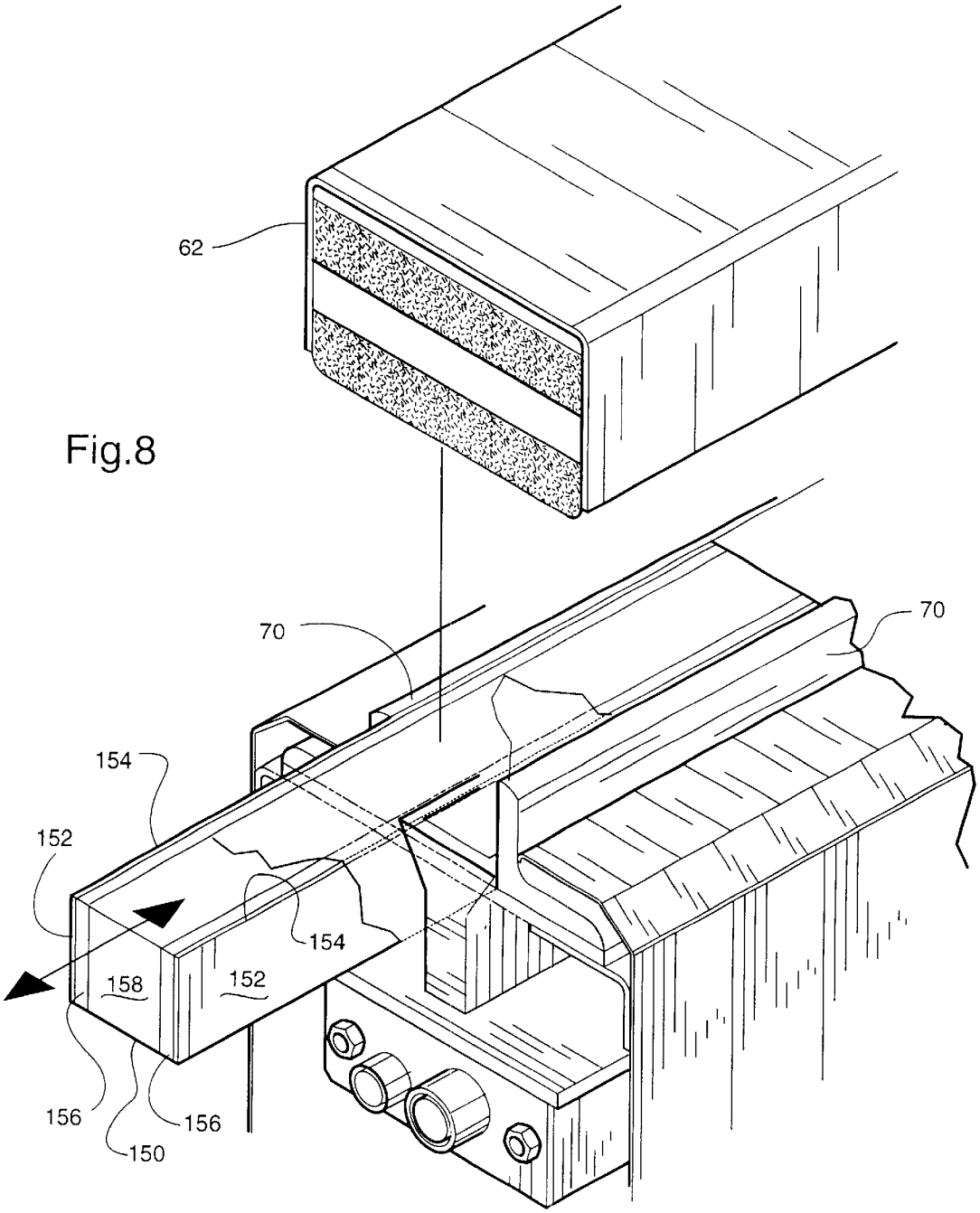
FIG. 8 is an enlarged exploded view of an end of the applicator head of FIG. 2 illustrating an end seal according to the present invention.
Figure 9:
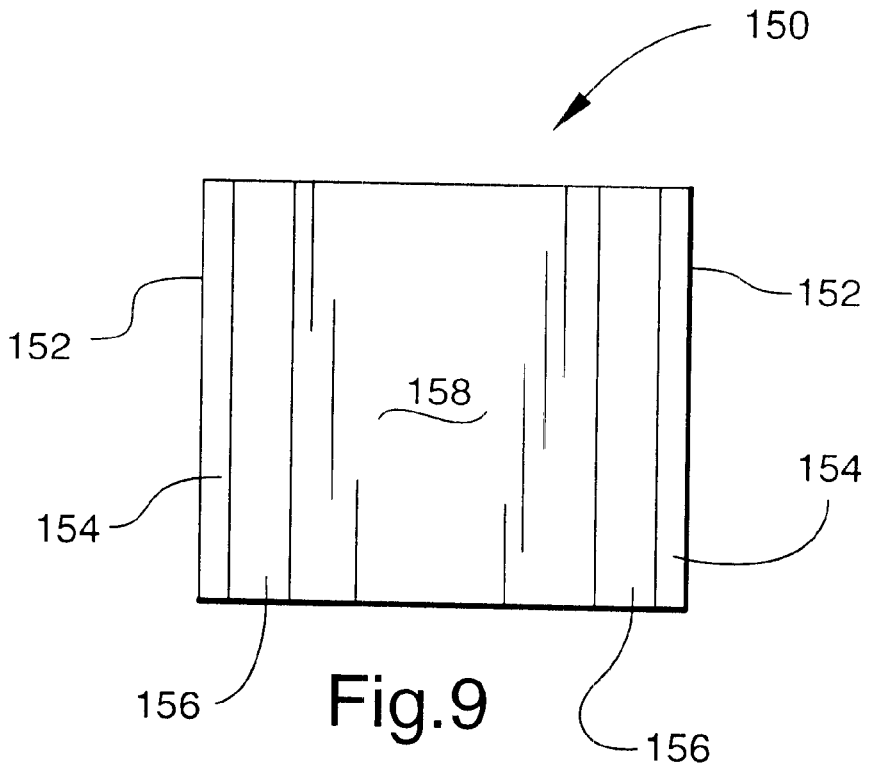
FIG. 9 is an end view of the end seal of FIG. 8.
Figure 10:
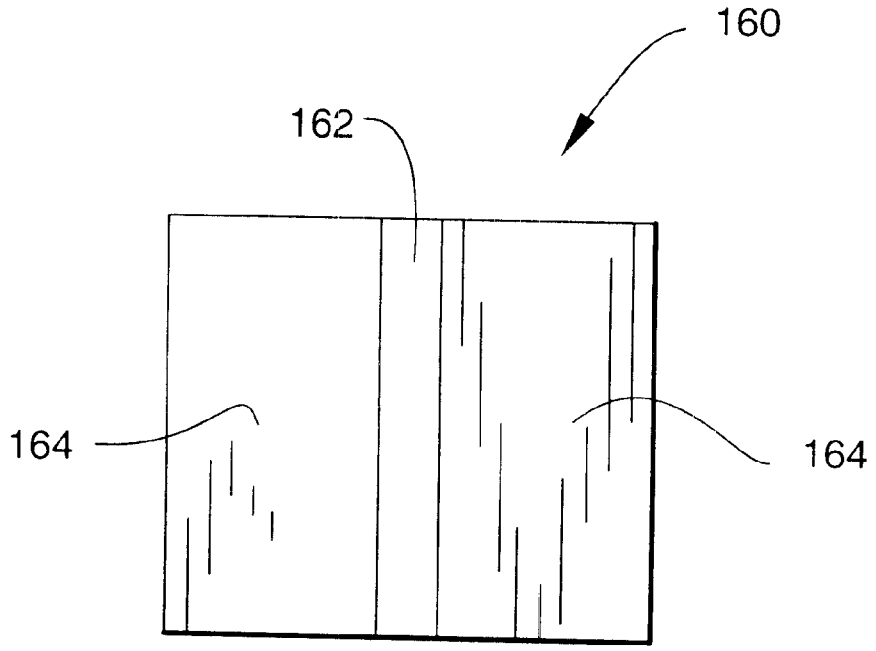
FIG. 10 is an end view of an alternate form of end seal for use in the applicator head illustrated in FIG. 8.

Conventionally, adjustable end seals are provided in the slots of foam applicators to accommodate application of foam to different widths of yarn sheets. Such end seals are adjustable manually or automatically in conventional manners. The problem with end seals is that of maintaining adequate sealing between the sides of the end seal and the plates that form the sides of the foam chamber adjacent the slot. As seen in FIGS. 8–10, the present invention provides an end seal block that has rigid side surfaces 152 in contact with the adjacent sides of the angle bars 70 that form the chamber 58. These side surfaces 152 are formed of rigid metal plates that can readily slide in contact with the angle bars 70 for ease of adjustment. These side plates 154 are maintained in contact with the angle bars 70 by resilient plastic foam blocks 156 that are secured on their inner sides to a rigid core 158 and on their outer sides to the rigid plates 154. These foam plastic blocks 156 are compressable when inserted between the angle bars 70 and press the rigid plates 54 tightly against the surfaces of the angle bars 70. This arrangement is shown in FIGS. 8 and 9. FIG. 10 illustrates a variation where the end seal block 160 is formed with a foam plastic core 162 with rigid metallic bars 164 secured outwardly to the foam core 162 with the foam core 162 being compressable to permit insertion of the end seal block 160 between the angle bars 70 and to apply sealing pressure to the rigid bars 164 against the sides of the angle bars 70.

Figure 11:
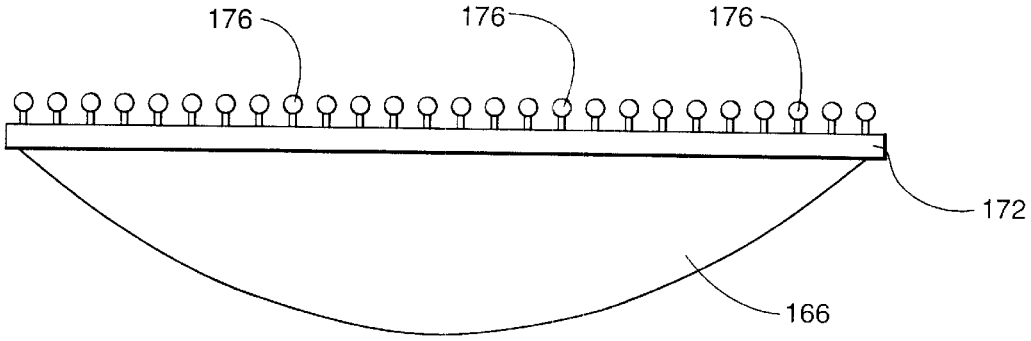
FIG. 11 is a view similar to FIG. 3 showing an alternate form of applicator head utilizing tubes rather than a slot.
Figure 12:
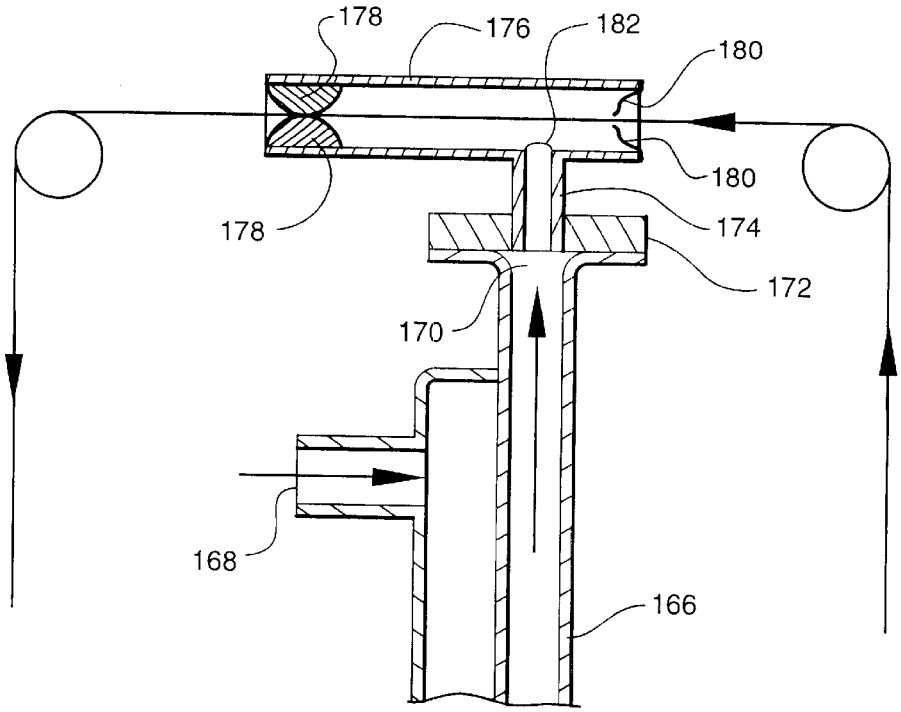
FIG. 12 is an enlarged cross-sectional view of FIG. 11, taken along line 12—12 of FIG. 11.

An alternative form of applicator is illustrated in FIGS. 11 and 12. In this embodiment, a foam distribution chamber 166 identical to the chamber 42 with foam from a foam generator entering through an inlet 162 for distribution uniformly along an exit slot 170. In this embodiment, the slot 170 does not open to the traveling yarn sheet 20, but is covered by a horizontal plate 172 that has a plurality of upstanding feed tubes 174 that support at their upper ends applicator tubes 176 extending horizontally in the direction of travel of the yarn sheet 20. Single or multiple yarns of the sheet pass through each of the applicator tubes 176 with the foam under pressure being maintained in the tubes 176 by resilient sealing pads 178 through which the yarns pass at the exit end of the applicator tubes and by sealing flaps 180 at the entry end of the applicator tubes 176. Preferably, the feed tubes 174 form openings 182 into the applicator tubes 176 adjacent the entry ends of the applicator tubes 176.

While both the slot and the tube applicator embodiments illustrated and described herein utilize a parabolic foam distribution chamber, it should be understood that the present invention is not limited to any particular type of foam distribution system. Any other type of distribution system that provides sufficient uniformity of foam pressure across the width of the traveling yarn sheet can be used.

The amount and type of surfactant to be contained in the foam applied by the present invention may be selected conventionally for optimum results. Further, in an alternate form of the present invention, the size can be applied through the applicator, thereby eliminating the need for a size box. In such a case, the amount of size necessary to be applied can be determined from the particular application.

It should also be understood that the above described features of the use of a protective sheet 112, applicator tubes 176, and valve assembly 52 have application to foam applicators generally and are not limited to use with foam applicators in textile yarn slashing systems.

For guiding of the yarns 18 of the sheet 20 in proper alignment, it may be desirable to have the top edges of the angle bars 70 serrated to maintain separate parallelism of the yarns. Also, the edges of the top surfaces of the angle bars 70 can be relieved or otherwise to minimize foam or fiber accumulation during foam application to the traveling yarn sheet.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a textile yarn slashing system in which yarns are from a yarn supply device as a sheet of individual aligned yarns, through a size box for pick up of size, and through a dryer, the improvement comprising a foam applicator disposed between said yarn supply device and said size box and through which said sheet of yarns from said supply device passes for pre-wetting of said sheet of yarns, whereby said pre-wetting reduces the amount of size pickup by the yarns needed to properly condition the yarns for subsequent processing, said applicator being characterized further in that said applicator is a pressure applicator and has a slot extending across and facing one surface of the sheet of yarns for delivery of foam thereto, and a holddown member opposing and covering said slot for passage of the sheet of yarns therebetween and defining with the slot a foam pressure chamber for application of foam under pressure to the sheet of yarns passing therethrough.

2. In a textile yarn slashing system according to claim 1, said applicator being characterized further in that said slot extends lengthwise transversely across and facing one surface of the sheet of yarns for delivery of foam thereto, the extent of the slot in the direction of yarn sheet advance being sufficiently wide to extend the exposure of the sheet of yarns to the foam in the slot for optimum application of foam.

3. In a textile yarn slashing system according to claim 1, said applicator being characterized further in that said holddown member is formed to provide a space opposite said slot and facing the other surface of the sheet of yarns for containing and distributing over the other surface of the sheet of yarns pressurized foam that passes from said slot through the sheet of yarns into said space.

4. In a textile yarn slashing system according to claim 3, said applicator being characterized further in that said holddown member is formed of resilient material that is compressed by pressurized foam to provide said space.

5. In a textile slashing system according to claim 4, said applicator being characterized further by a sheet of flexible material covering said resilient holddown member and forming a yarn contacting surface.

6. In a textile slashing system according to claim 5, said applicator being characterized further in that said covering sheet being advanceable from a supply to replace worn covering material with unworn covering material.

7. In a textile yarn slashing system according to claim 4, said applicator being characterized further in that said slot is sufficiently wide to provide a desired extent of compression of said holddown member and to extend the exposure of the sheet of yarns to the foam in said slot and space for optimum application of foam.

8. In a textile yarn slashing system according to claim 1, said applicator being characterized further in that said applicator is a first applicator facing one surface of the sheet of yarns and a second foam applicator is provided facing the other surface of the sheet of yarns and at a spacing from said first applicator lengthwise of the sheet of yarns.

9. An applicator for applying foam material to a traveling substrate comprising a slotted member having a slot facing one surface of the traveling substrate and extending thereacross, a resilient holddown member opposing and covering said slot for passage of the substrate therebetween, and a sheet of flexible material covering said resilient holddown member and forming a substrate contacting surface, said covering sheet being advanceable from a supply to replace worn covering material with unworn covering material.

10. An applicator according to claim 9 and characterized further in that said applicator is a pressure applicator, said holddown member defining with the slot a foam pressure chamber and being compressed by pressurized foam to provide a space opposite said slot and through which the substrate travels.

11. In a textile yarn slashing system in which yarns are fed from a yarn supply device as a sheet of individual aligned yarns, through a size box for pick up of size, and through a dryer, the improvement comprising a foam applicator disposed between said yarn supply device and said size box and through which said sheet of yarns from said supply device passes for pre-wetting of said sheet of yarns, whereby said pre-wetting reduces the amount of size pickup by the yarns needed to properly condition the yarns for subsequent processing, said applicator being characterized further in that said applicator comprises a plurality of parallel tubes containing foam and through which the yarns of said sheet of yarns advance.

12. In a textile yarn slashing system according to claim 11, said applicator being characterized further in that said tubes have upstream ends and openings adjacent said upstream ends through which openings foam is introduced into said tubes.

13. In a textile yarn slashing system according to claim 11, said applicator being characterized further in that said applicator is a pressure applicator and foam seals are provided at the upstream and downstream ends of said tubes through which said yarns advance.

14. In a textile strand slashing system in which strands are fed from a strand supply device as a sheet of individual aligned strands, through a size box for pick up of size, and through a dryer, the improvement comprising a foam applicator disposed between said strand supply device and said size box and through which said sheet of strands from said supply device passes for pre-wetting of said sheet of strands, whereby said pre-wetting reduces the amount of size pickup by the strands needed to properly condition the strands for subsequent processing, said applicator comprising a plurality of parallel tubes containing foam and through which the strands of said sheet of strands advance.

15. In a strand slashing system according to claim 14 and characterized further in that said tubes have upstream ends and openings adjacent said upstream ends through which openings foam is introduced into said tubes.

16. In a strand slashing system according to claim 14 and characterized further in that said foam applicator is a pressure applicator and foam seals are provided at the upstream and downstream ends of said tubes through which said strands advance.

17. In a textile foam slashing system in which yarns are fed from a yarn supply device as a sheet of individual aligned yarns, through a size box for pick up of size, and through a dryer, the improvement comprising a foam applicator disposed between said yarn supply device and said size box and through which said sheet of yarns from said supply device passes for pre-wetting of said sheet of yarns, whereby said pre-wetting reduces the amount of size pickup by the yarns needed to properly condition the yarns for subsequent processing, said applicator being characterized further in that said applicator has a main foam passage through which foam is supplied to said sheets of yarn, a by-pass passage through which foam may be discharged from said main passage and a normally closed valve in said by-pass passage that is closed during foam application through said main passage and is openable for by-passing foam from said applicator.

18. In a textile yarn slashing system according to claim 17, said applicator being characterized further by a normally open valve in said main passage downstream from said by-pass passage that is closable upon opening of said valve in said by-pass passage.

19. In a textile yarn slashing system according to claim 18, said applicator being characterized further in that said valves are inflatable bladders that are inflated to extend across said passages to close said passages.

20. An applicator for applying foam material to a traveling substrate comprising a main foam passage having an end through which foam is supplied to said substrate, a by-pass passage through which foam may be discharged from said main passage and a normally closed valve in said by-pass passage adjacent said main foam passage end that is closed during foam application through said main passage and is openable for by-passing foam from said applicator.

21. An applicator according to claim 20, and characterized further by a normally open valve in said main passage downstream from said by-pass passage that is closable upon opening of said valve in said by-pass passage.

22. An applicator according to claim 21 and characterized further in that said valves are inflatable bladders that are inflated to extend across said passages to close said passages.

23. In a textile yarn slashing system in which yarns are fed from a yarn supply device as a sheet of individual aligned yarns, through a size box for pick up of size, and through a dryer, the improvement comprising a foam applicator disposed between said yarn supply device and said size box and through which said sheet of yarns from said supply device passes for pre-wetting of said sheet of yarns, whereby said pre-wetting reduces the amount of size pickup by the yarns needed to properly condition the yarns for subsequent processing, said applicator being characterized further in that said applicator has a slot extending lengthwise transversely across and facing one surface of the sheet and a passage extending from said slot and having straight sides adjacent said slot for delivery of foam therethrough to said slot, an adjustable end seal member in said straight sided passage having flat side surfaces of rigid material disposed in sealing relation to the straight sides of said passage and having resilient interior material urging said side surfaces into sealing engagement with said passage straight sides.

24. In a textile yarn slashing system according to claim 23, said applicator being characterized further in that said seal member comprises a rigid core having sides extending generally parallel with said passage, a layer of said resilient interior material secured to each side of said core and said rigid material side surfaces secured to said resilient layers.

25. In a textile yarn slashing system according to claim 24, said applicator being characterized further in that said seal member comprises said resilient interior material in the form of a core having sides extending generally parallel with said passage, a layer of rigid material secured to each side of said core and forming said flat side surfaces.

26. An applicator for applying foam material to a traveling substrate comprising a slotted member having a slot facing one surface of the traveling substrate and extending thereacross, said slotted member having a passage extending from said slot and having straight sides adjacent said slot for delivery of foam therethrough to said slot, an adjustable end seal member in said straight sided passage having flat side surfaces of rigid material disposed in sealing relation to the straight sides of said passage and having resilient interior material urging said side surfaces into sealing engagement with said passage straight sides.

27. An applicator according to claim 26 and characterized further in that said seal member comprises a rigid core having sides extending generally parallel with said passage, a layer of said resilient interior material secured to each side of said core and said rigid material side surfaces secured to said resilient layers.

28. An applicator according to claim 26 and characterized further in that said seal member comprises said resilient interior material in the form of a core having sides extending generally parallel with said passage, a layer of rigid material secured to each side of said core and forming said flat side surfaces.

29. In a textile yarn slashing system the improvement comprising a foam applicator disposed for passage of a sheet of individual aligned yarns therethrough, said applicator applying foam under pressure with the foam containing a sufficient amount of sizing material therein to properly condition the yarn for subsequent processing, said applicator having a slot extending across and facing one surface of the sheet of yarns for delivery of foam thereto, and a holddown member facing the other surface of the sheet of yarns and opposing and covering said slot for passage of the sheet of yarns therebetween and defining with the slot a foam pressure chamber through which the sheet of yarns passes for application of foam under pressure to both surfaces of the sheet of yarns passing therethrough.

30. In a textile yarn slashing system according to claim 29, said applicator being characterized further in that said holddown member is formed to provide a space opposite said slot and facing the other surface of the sheet of yarns for containing and distributing over the other surface of the sheet of yarns pressurized foam that passes from said slot through the sheet of yarns into said space.

31. In a textile yarn slashing system according to claim 30, said applicator being characterized further in that said holddown member is formed of resilient material that is compressed by pressurized foam to provide said space.

32. In a textile yarn slashing system according to claim 31, said applicator being characterized further in that said slot is sufficiently wide to provide a desired extent of compression of said holddown member and to extend the exposure of the sheet of yarns to the foam in said slot and space for optimum application of foam.

* * * * *